US010275978B2

(12) United States Patent
Yang et al.

(10) Patent No.: US 10,275,978 B2
(45) Date of Patent: Apr. 30, 2019

(54) COIN-OPERATED WASHER/DRYER

(71) Applicant: QINGDAO HAIER WASHING MACHINE CO., LTD., Qingdao, Shandong (CN)

(72) Inventors: Kun Yang, Qingdao (CN); Yiping Bian, Qingdao (CN); Gongfa Ma, Qingdao (CN); Bin Zhang, Qingdao (CN); Lin Hou, Qingdao (CN)

(73) Assignee: QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 0 days.

(21) Appl. No.: 15/576,263

(22) PCT Filed: May 24, 2016

(86) PCT No.: PCT/CN2016/083136

§ 371 (c)(1),
(2) Date: Nov. 21, 2017

(87) PCT Pub. No.: WO2016/188403

PCT Pub. Date: Dec. 1, 2016

(65) Prior Publication Data

US 2018/0197364 A1 Jul. 12, 2018

(30) Foreign Application Priority Data

May 26, 2015 (CN) ..... 2015 1 0275324

(51) Int. Cl.

| | |
|---|---|
| ***G07F 9/06*** | (2006.01) |
| ***D06F 37/02*** | (2006.01) |
| ***D06F 39/00*** | (2006.01) |
| ***D06F 95/00*** | (2006.01) |
| ***G07F 17/20*** | (2006.01) |

(52) U.S. Cl.
CPC ..... *G07F 17/20* (2013.01); *D06F 37/02* (2013.01); *D06F 39/00* (2013.01); *D06F 95/00* (2013.01); *G07F 9/06* (2013.01)

(58) Field of Classification Search
CPC . G07F 17/20; G07F 9/06; D06F 39/00; D06F 37/20; D06F 95/00
See application file for complete search history.

(56) References Cited

U.S. PATENT DOCUMENTS 3,335,945 A * 8/1967 Hutchins ..... G07F 15/00 232/1 R
3,339,835 A * 9/1967 Itman ..... G07F 9/06 232/1 R (Continued)

FOREIGN PATENT DOCUMENTS

| | | |
|---|---|---|
| CA | 2511288 | 12/2006 |
| CN | 101672418 | 3/2010 |
| CN | 102605587 | 7/2012 |

OTHER PUBLICATIONS

International Application No. PCT/CN2016/083136, International Search Report, dated Aug. 30, 2016.

*Primary Examiner* — Daniel J Rohrhoff
(74) *Attorney, Agent, or Firm* — Greenberg Traurig, LLP

(57) ABSTRACT

A coin-operated washing/drying machine including a cabinet and a coin box assembly disposed within the cabinet. A supporting structure is fixedly disposed within the cabinet. At least a bottom surface of the coin box assembly is fixedly connected with the supporting structure by a fastener. The fastener passes through from the interior of the coin box assembly and is fixedly connected with the supporting structure. The supporting structure is disposed within the cabinet; the bottom surface of the coin box assembly is fixedly connected with the supporting structure; the fasteners such as screws are thus invisible from an overall appear- (Continued)

ance. Since the coin box assembly is fixed to the supporting structure by the bottom surface to cause such a fixing structure to be hidden in the bottom surface of the coin box assembly, thereby achieving a good anti-theft effect.

11 Claims, 7 Drawing Sheets

(56) References Cited

U.S. PATENT DOCUMENTS 3,590,654 A * 7/1971 Butte ..... G07F 5/02 194/241
3,922,048 A * 11/1975 Christianson ..... D06F 39/12 232/15
4,881,632 A * 11/1989 LiCausi ..... G07F 1/02 194/350
5,291,981 A * 3/1994 Anello ..... G07F 9/04 194/350
5,873,446 A * 2/1999 Wei ..... G07D 11/0009 194/350
7,410,095 B2 * 8/2008 Selover ..... G07F 9/06 194/350
9,196,112 B2 11/2015 Heo
2004/0107738 A1 * 6/2004 Kim ..... D06F 37/20 68/3 R
2007/0000988 A1 1/2007 Selover
2011/0241508 A1 * 10/2011 Heo ..... D06F 31/00 312/237

* cited by examiner

COIN-OPERATED WASHER/DRYER

The present application is a national phase application under 35 U.S.C. § 371 of International Patent Application PCT/CN2016/083136, filed on May 24, 2016, which claims priority to Chinese patent application No. 201510275324.0, filed on May 26, 2015, the entire disclosures of which applications are hereby incorporated herein by reference.

TECHNICAL FIELD

The present disclosure relates to the technical field of washing and drying devices and, for example to a coin-operated washing/drying machine.

BACKGROUND

Traditional ways of washing clothes are time-consuming and inconvenient. With improvement of life rhythm and life quality, urbanites increasingly need an efficient, convenient and hygienic way of washing clothes. A self-service way of washing clothes emerges at the right moment, thereby gradually forming a new consumption trend. Consequently, a coin-operated commercial washing/drying machine is used widely. The operation of the coin-operated commercial washing/drying machine is automatically controlled by a coin-inserting system, so that the coin-operated commercial washing/drying machine is easy to operate, needs no personnel on duty, greatly reducing management cost. Therefore, the coin-operated commercial washing/drying machine becomes a preference in public places such as schools, factories, and hotels.

SUMMARY

In a related coin-operated washing machine, a coin box is fixed with a cabinet of the washing machine by a fastener. The fastener is exposed to an outer surface of the washing machine, thereby easily attracting attentions of thieves. In order to enhance an anti-theft effect, the fastener is usually arranged as an uncommon special-shaped screw, preventing stealing and being difficult to disassemble. However, with diversification of tools, special disassembling tools for disassembling the special-shaped screws can be easily available at present. Even if the tools are unavailable, the thieves can easily search for relatively simple ways to disassemble the special-shaped screws. Once the screws are removed, the coin box inside or outside the machine is very easy to be stolen.

To solve problems that the coin box is easy to be stolen in an existing coin-operated washing/drying machine to cause a poor anti-theft effect, a novel coin-operated washing/drying machine needs to be provided.

Embodiments of the present disclosure are to provide a coin-operated washing/drying machine in which the coin box is not easy to be removed to achieve good anti-theft effect.

Embodiments of the present disclosure adopt the following technical solutions:

A coin-operated washing/drying machine includes a cabinet and a coin box assembly disposed within the cabinet; a supporting structure is fixedly disposed within the cabinet; at least a bottom surface of the coin box assembly is fixedly connected with the supporting structure by a fastener; and the fastener passes through the interior of the coin box assembly and is fixedly connected with the supporting structure.

Alternatively, the coin-operated washing/drying machine further includes a drum supporting element for supporting a drum within the cabinet; and the supporting structure is fixed on the drum supporting element.

Alternatively, the supporting structure is fixed on the drum supporting element in a welding manner.

Alternatively, the supporting structure is an L-shaped bent plate including a first plate and a second plate; one side surface of the first plate is welded to the drum supporting element; and the second plate is fixedly connected with the bottom surface of the coin box assembly by the fastener; and the fastener passes through the interior of the coin box assembly to be fixedly connected with the second plate.

Alternatively, one side edge of each of the first plate and the second plate is welded to a side plate of the cabinet close to the coin box assembly.

Alternatively, the fastener is a screw or a bolt.

Alternatively, the coin box assembly includes a coin inserting portion and a coin storage box; an inlet is disposed at a top surface of the coin storage box; and the coin insertion portion has a coin channel leading into the inlet; and a cross beam is connected between the tops of two side plates of the cabinet; and the top surface of the coin storage box is fixedly connected with a bottom surface of the cross beam.

Alternatively, a three-side coaming plate, a top cover plate and a front control panel on a front side are disposed at the top of the cabinet; and close the cabinet together;

a coin slot is disposed in the coin insertion portion; a first opening is disposed in the control panel; and the coin insertion portion passes into the first opening from a back surface of the control panel so as to expose the coin slot to the outside; and the coin storage box includes a housing and a lockable drawer disposed within the housing in a pushing-pulling manner; a second opening is disposed in the control panel; and the coin storage box passes into the second opening from the back surface of the control panel so as to expose a keyhole of the lockable drawer to the outside.

Alternatively, the three-side coaming plate includes a first coaming plate, a second coaming plate and a third coaming plate which are fixed with a back plate and two side plates of the cabinet by the fasteners, respectively; and the top cover plate is provided with a positioning hole, and is fixedly connected with the second coaming plate and the third coaming plate by positioning screws.

Alternatively, the positioning hole includes a first hole close to the control panel, a second hole far away from the control panel and a straight hole for communicating the first hole with the second hole.

Each of the positioning screws includes a nut, a first positioning portion, a second positioning portion and a thread portion successively from top to bottom.

An external dimension of the nut is smaller than that of the first positioning portion; an external dimension of the first positioning portion is smaller than a dimension of the first hole and greater than a dimension of the second hole; and an external dimension of the second positioning portion is adapted to dimensions of the straight hole and the second hole.

One side edge of the top cover plate is located between the first positioning portion and the top surface of the second coaming plate; the other side edge of the top cover plate is located between the first positioning portion and the top surface of the third coaming plate; the second positioning portion is matched with the second hole; and the thread portion is in threaded connection with the second coaming plate and/or the third coaming plate so as to fix the top cover plate.

In the coin-operated washing/drying machine according to embodiments of the present disclosure, the supporting structure is disposed within the cabinet; the bottom surface of the coin box assembly is fixedly connected with the supporting structure by the fastener; the fasteners such as screws are thus invisible from an overall appearance, so that thieves have no way of stealing to eliminate their stealing intention or give up stealing. In addition, since the fasteners passes through from the interior of the coin box assembly and is fixed with the supporting structure to cause such a fixing structure to be hidden in the bottom of the coin box assembly, even if the thieves can open an overall housing, the coin box assembly is unable to or not easy to be removed, thereby achieving a good anti-theft effect.

Figure 1:
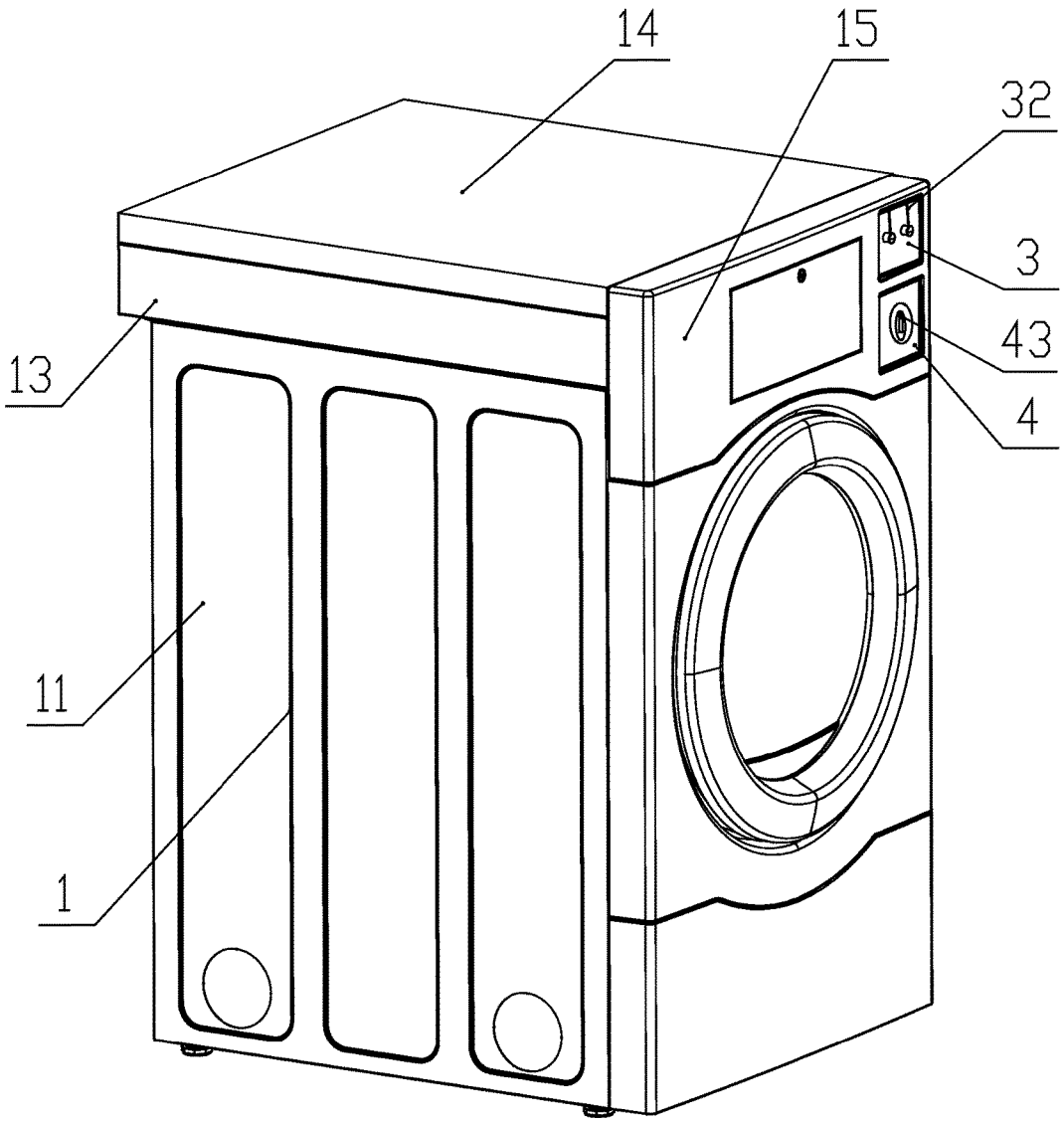
FIG. 1 is a structural schematic diagram illustrating a coin-operated washing/drying machine according to embodiments of the present disclosure.

A list of reference numerals: 1: cabinet; 11: side plate; 12: cross beam; 13: three-side coaming plate; 131: first coaming plate; 132: second coaming plate; 133: third coaming plate; 14: top cover plate; 141: positioning hole; 1411: first hole; 1412: second hole; 1413: straight hole; 15: control panel; 151: first opening; 152: second opening; 16: back plate; 2: supporting structure; 21: first plate; 22: second plate; 3: coin insertion portion; 31: coin channel; 32: coin slot; 4: coin storage box; 41: inlet; 42: mounting portion; 43: keyhole; 44: housing; 5: positioning screw; 51: nut; 52: first positioning portion; 53: second positioning portion; 54: thread portion; and 6: drum supporting element.

DETAILED DESCRIPTION

Embodiments of the present disclosure provide a coin-operated washing/drying machine including a cabinet and a coin box assembly disposed within the cabinet. A supporting structure is fixedly disposed within the cabinet. At least a bottom surface of the coin box assembly is fixedly connected with the supporting structure by a fastener. The fastener passes through from the interior of the coin box assembly and is fixedly connected with the supporting structure.

In the coin-operated washing/drying machine according to embodiments of the present disclosure, the bottom surface of the coin box assembly is fixedly connected with the supporting structure by the fastener, the fasteners such as screws are thus invisible from an overall appearance, so that thieves have no way of stealing to eliminate their stealing intention or give up stealing. In addition, since the fastener passes through from the interior of the coin box assembly and is fixed with the supporting structure to cause such a fixing structure to be hidden in the bottom of the coin box assembly, even if the thieves can open an overall housing, the coin box assembly is unable to or not easy to be removed, thereby achieving a good anti-theft effect.

Figure 2:
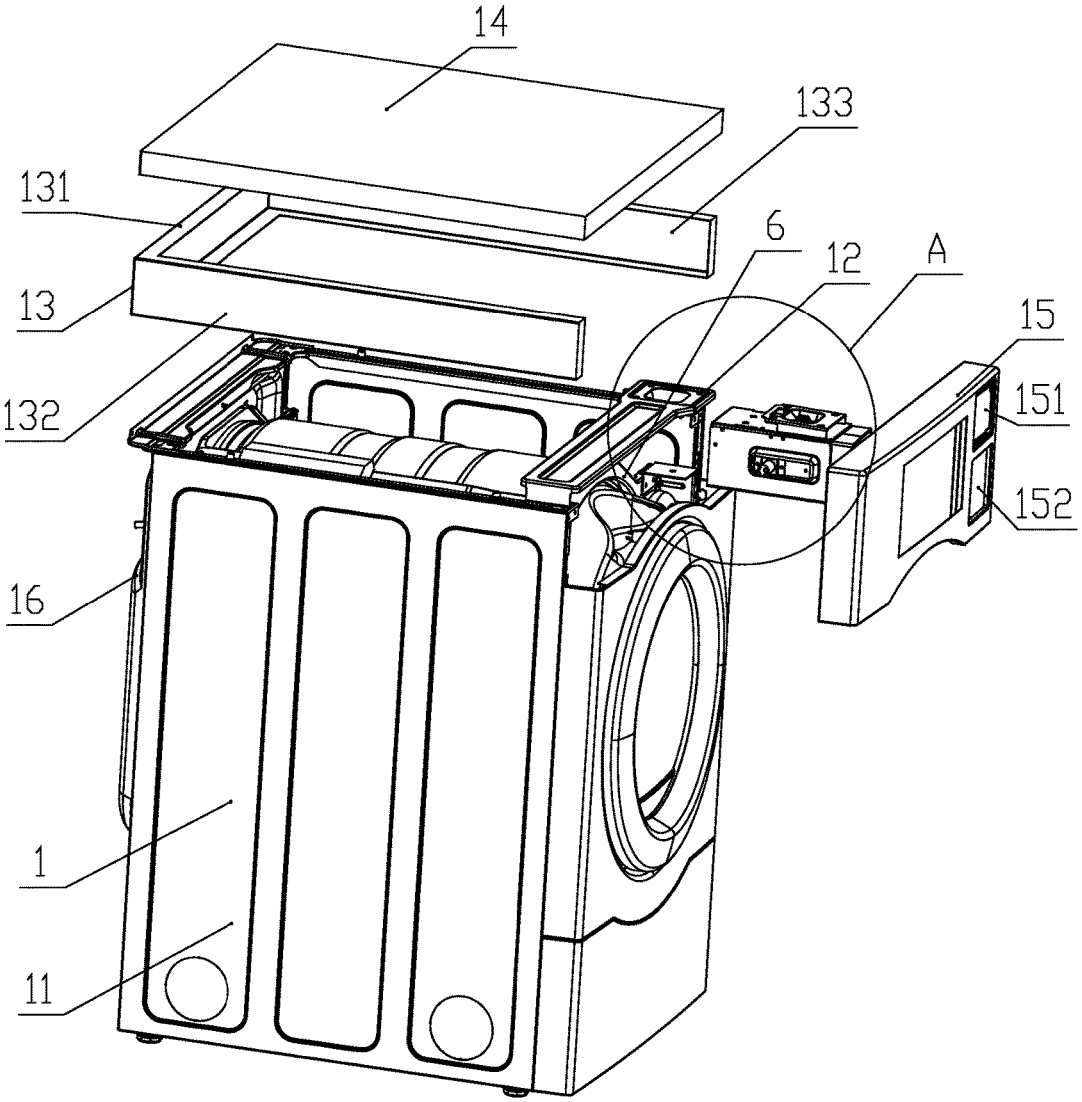
FIG. 2 is a structural exploded view illustrating the coin-operated washing/drying machine according to the embodiments of the present disclosure.
Figure 3:
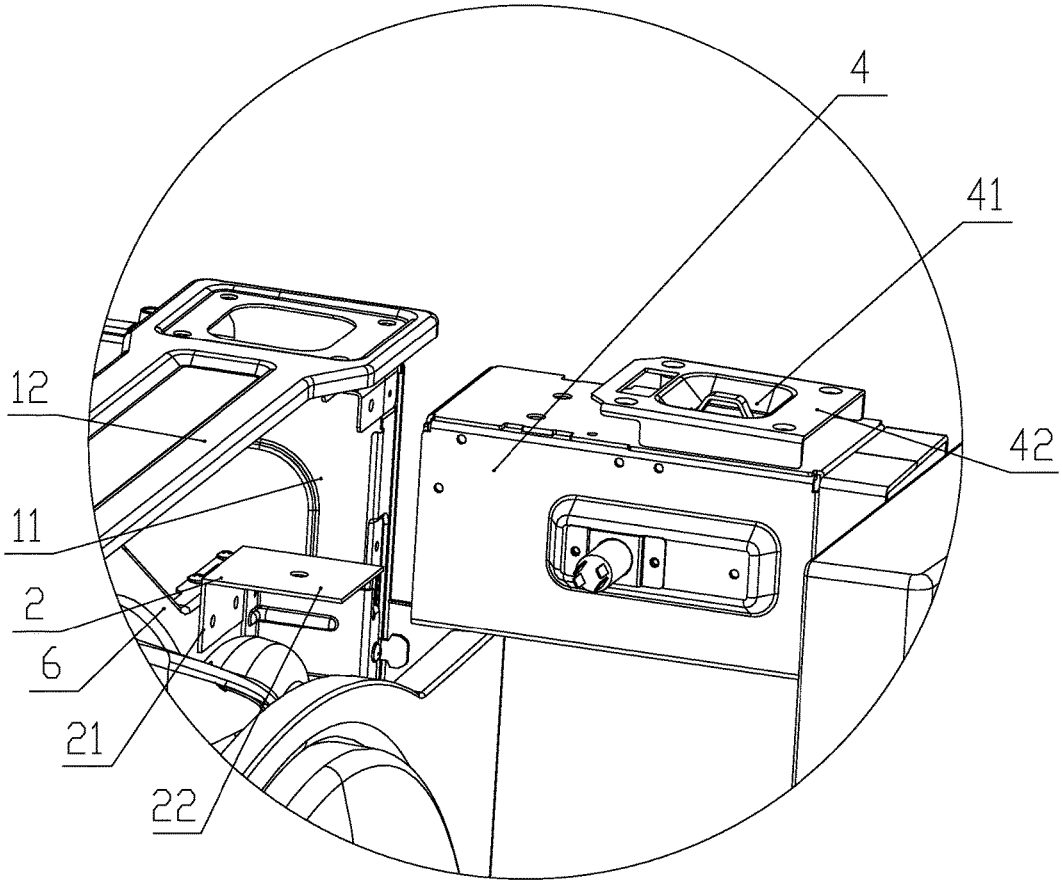
FIG. 3 is a structural enlarged view illustrating detail A in FIG. 2.
Figure 4:
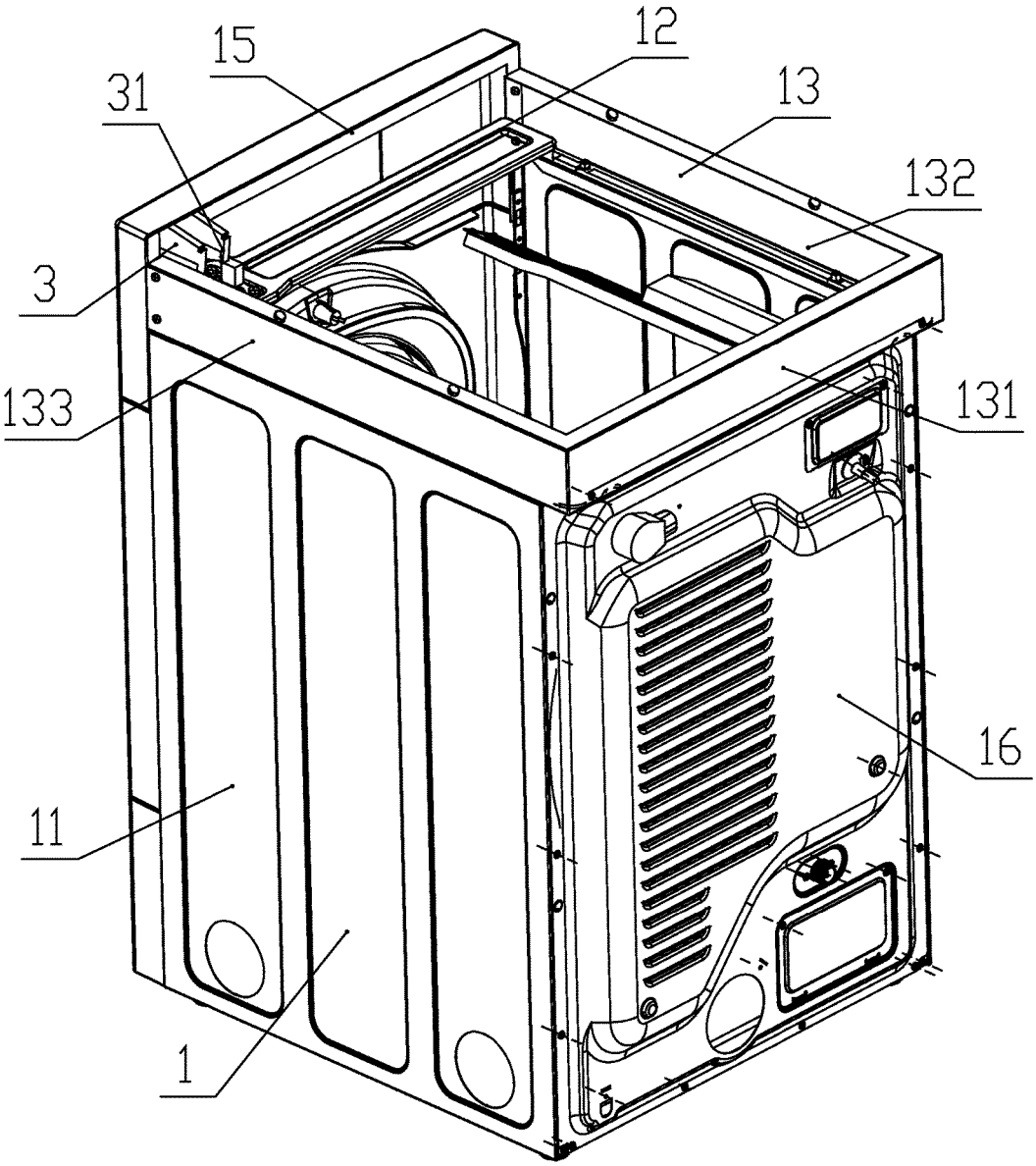
FIG. 4 is a structural schematic diagram according to the embodiments of the present disclosure with removing a top cover plate.
Figure 5:
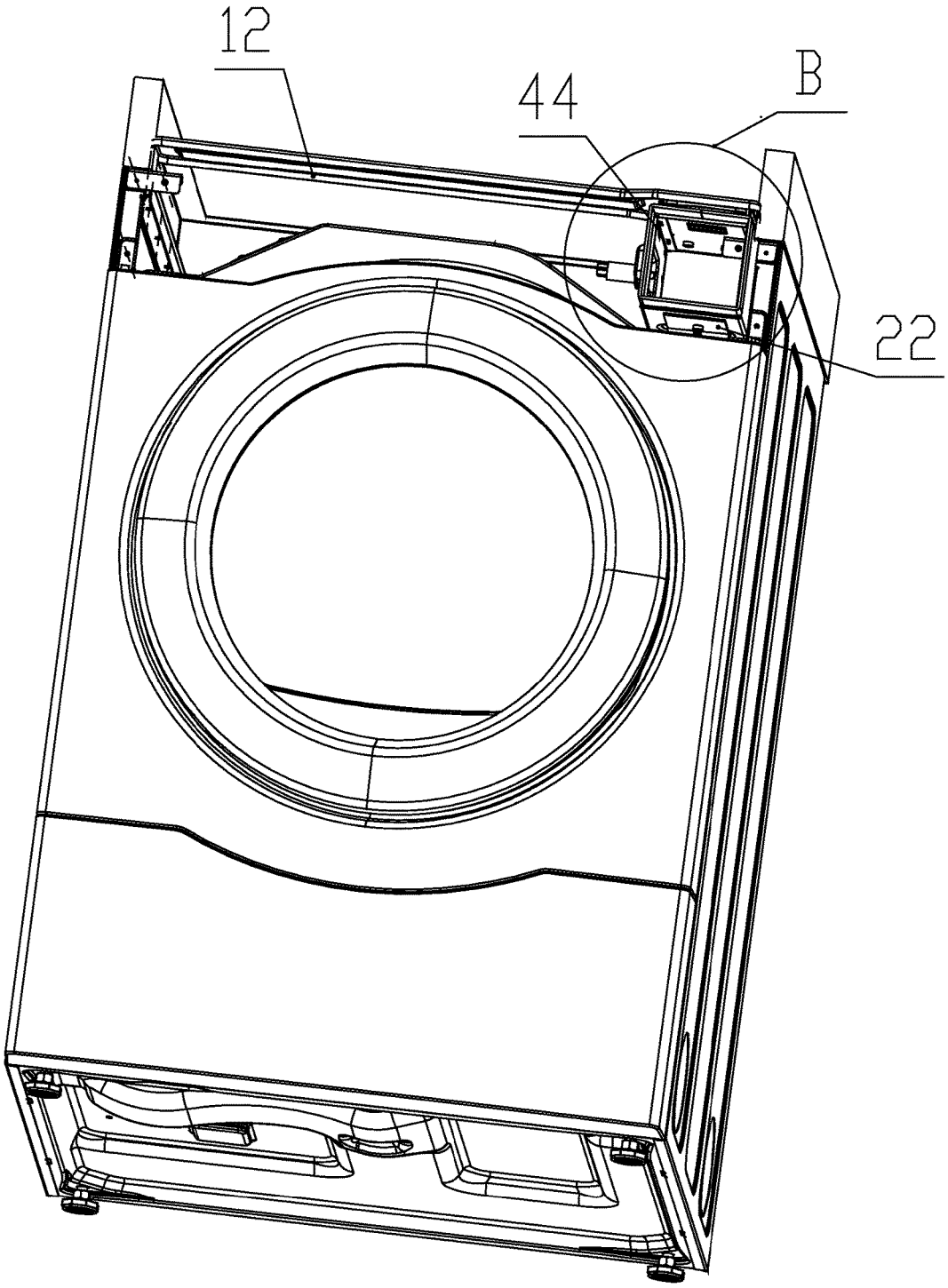
FIG. 5 is a structural schematic diagram according to the embodiments of the present disclosure with removing a top cover plate and a control panel.
Figure 6:
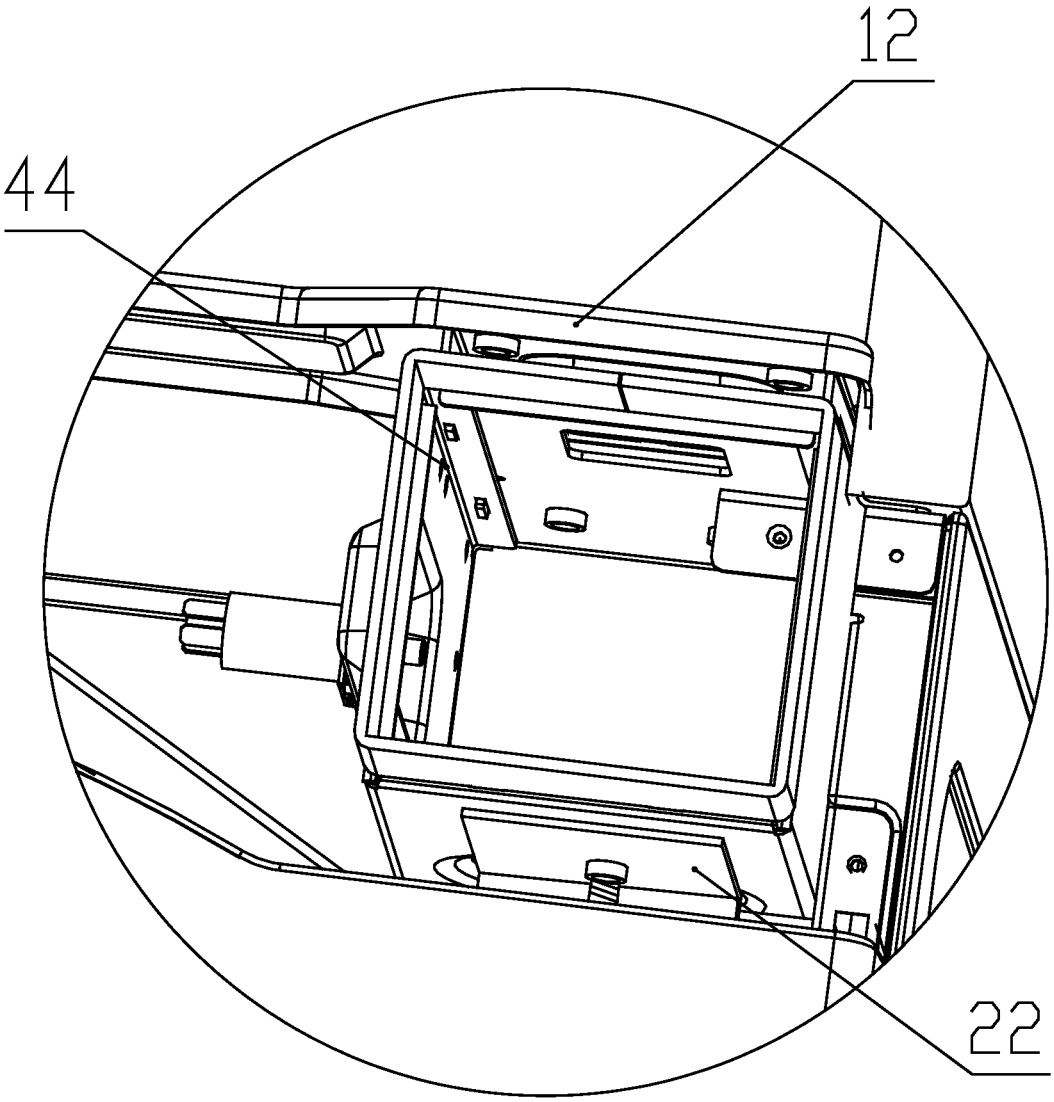
FIG. 6 is a structural enlarged view illustrating detail B in FIG. 5.
Figure 7:
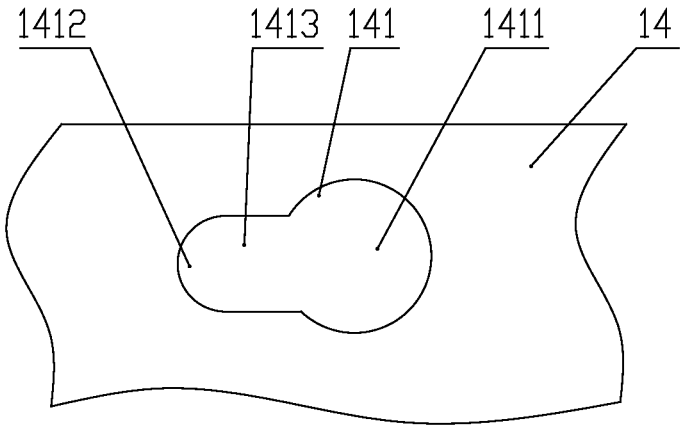
FIG. 7 is a structural schematic diagram illustrating a positioning hole of the top cover plate according to the embodiments of the present disclosure.
Figure 8:
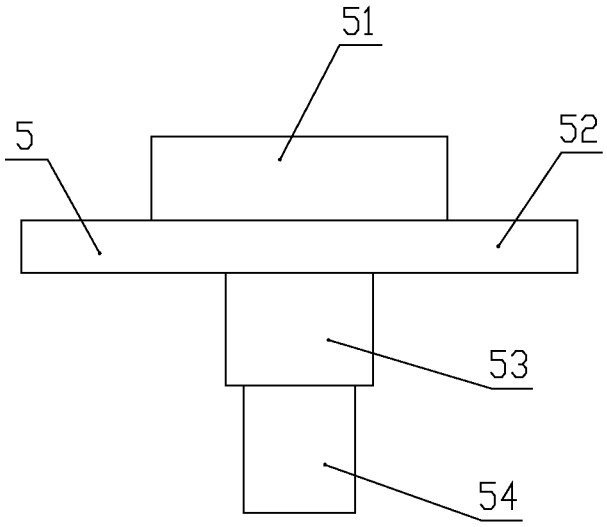
FIG. 8 is a structural schematic diagram illustrating a positioning screw according to the embodiments of the present disclosure.

Embodiments of the present disclosure provide a coin-operated washing/drying machine. As shown in FIG. 1 to FIG. 8, the coin-operated washing/drying machine includes a cabinet 1 as well as a drum and a coin box assembly disposed within the cabinet 1. A supporting structure 2 is fixedly disposed within the cabinet 1. A bottom surface of the coin box assembly is fixedly mounted on the supporting structure 2. No fastener is disposed on an appearance surface, i.e., a front surface, of the coin box assembly, so that thieves have no way of stealing to eliminate their stealing intention or give up stealing.

The drum is supported in the cabinet 1 by a drum supporting element 6 which is a plate-like structure and is disposed in a front portion within the cabinet 1. Both ends of the plate-like structure are fixed with inner walls of two side plates 11 of the cabinet 1. The supporting structure 2 may be fixed on the drum supporting element 6 in a welding manner.

According to the embodiment, the coin box assembly includes a coin insertion portion 3 and a coin storage box 4. An inlet 41 is disposed at a top surface of the coin storage box 4. The coin insertion portion 3 has a coin channel 31 leading into the inlet 41.

The supporting structure 2 is an L-shaped bent plate including a first plate 21 and a second plate 22 arranged perpendicular to each other. A side surface of the first plate 21 is welded to the drum supporting element 6. The second plate 22 is fixedly connected with a bottom surface of the coin storage box 4 by a fastener. Fixing positions of the coin storage box are hidden in its bottom, increasing disassembly difficulty. Further, the fastener passes through from the interior of the coin storage box 4 and then is fixedly connected with the second plate 22, so the coin storage box 4 is difficult to be disassembled from the outside, thereby further improving the anti-theft effect. The fastener may be a screw, a bolt and the like.

For improving fastness and reliability of the supporting structure 2 for supporting the coin storage box 4, one side edge of each of the first plate 21 and the second plate 22 is fixed to one side plate 11 of the cabinet 1 close to the coin box assembly by welding.

Optionally, a cross beam 12 is connected between the tops of the two side plates 11 of the cabinet 1, and a top surface of the coin storage box 4 is fixedly connected with a bottom surface of the cross beam 12. According to the present embodiment, a mounting portion 42 is disposed to be protruded around an inlet 41 in the top surface of the coin storage box 4, and the cross beam 12 is fixedly connected with the mounting portion 42 by four screws.

A three-side coaming plate 13 and a top cover plate 14 and a front control panel 15 are disposed at the top of the cabinet 1, and close the cabinet 1 together. The coin insertion portion 3 passes through a first opening 151 disposed in the control panel 15 from a back surface of the control panel 15, so that a coin slot 32 disposed in the coin insertion portion 3 is exposed to the outside, facilitating a user to insert coins into the washing/drying machine by the coin slot 32. The coin storage box 4 includes a housing 44 and a lockable drawer disposed within the housing 44 in a pushing-pulling manner. The user inserts the coins into the lockable drawer through the inlet 41 in the housing 44. The coin storage box 4 passes through a second opening 152 disposed in the control panel 15 from the back surface of the control panel 15, so that a keyhole 43 of the lockable drawer is exposed to the outside, and the lockable drawer can be opened by a special key to withdraw the coins inside.

The three-side coaming plate 13 includes a first coaming plate 131, a second coaming plate 132 and a third coaming plate 133 which are fixed with a back plate 16 and two side plates 11 of the cabinet 1 by the fasteners, respectively. The top cover plate 14 is provided with positioning holes 141, and is fixedly connected with the second coaming plate 132 and the third coaming plate 133 by positioning screws 5. According to the present embodiment, the top cover plate 14 is connected with the top surface of the second coaming plate 132 by two spaced positioning screws 5 and is connected with the top surface of the third coaming plate 133 by two spaced positioning screws 5.

The positioning hole 141 includes a first hole 1411 close to the control panel 15, a second hole 1412 far away from the control panel 15 and a straight hole 1413 for communicating the first hole 1411 with the second hole 1412. Each of the positioning screws 5 includes a nut 51, a first positioning portion 52, a second positioning portion 53 and a thread portion 54 successively from top to bottom. An external dimension of the nut 51 is smaller than that of the first positioning portion 52; the external dimension of the first positioning portion 52 is smaller than dimension of the first hole 1411 and greater than dimension of the second hole 1412; and the external dimension of the second positioning portion 53 is adapted to dimensions of the straight hole 1413 and the second hole 1412.

A mounting process of the top cover plate 14 is provided as follows: firstly, the thread portions 54 of the positioning screws 5 are pre-mounted on the second coaming plate 132 and the third coaming plate 133; the first positioning portions 52 of the positioning screws 5 are inserted into the first holes 1411 of the corresponding positioning holes 141 in the top cover plate 14, respectively; the top cover plate 14 is then pushed toward a direction of the control panel 15 so that the second positioning portion 53 of the positioning screw 5 slides into the second hole 1412 along the straight hole 1413, thereby completing positioning of the top cover plate 14; finally, all the positioning screws 5 are tightened to complete mounting of the top cover plate 14.

A target for the thieves is the coins in the coin storage box 4. The coins are stored in the coin storage box 4 with a lock. The coins can be taken in two ways as follows:

1. The lock of the coin storage box 4 is opened to take away the coins. However, the possibility of opening the lock is relatively low. Since the space around the coin storage box is small and the coin storage box 4 is made of relatively thick steel plates, the coin storage box is less likely to be pried.

2. The coin storage box 4 is stolen. In response to this way, the mounting structure according to the present embodiment increases the stealing difficulty. Firstly, no screw structure exists on the exterior, so that the idea of stealing may be eliminated. Secondly, disassembly of the top cover plate 14 is relatively complicated, thereby increasing the stealing difficulty. Even if the thieves pry the control panel 15 and the top cover plate 14 and try to steal the coin storage box 4, since the thieves cannot open the coin storage box 4, the crucial screws inside the coin storage box 4 cannot be removed, and the coin storage box 4 cannot be stolen unless the complete machine is destroyed.

According to the present disclosure, not only the bottom surface of the coin storage box 4 but also other non-appearance surfaces of the coin storage box 4 can be connected with the supporting structure 2 to increase the stealing difficulty. The supporting structure 2 is not limited to be connected with the drum supporting element 6 as long as the supporting structure 2 is reliably fixed within the cabinet 1.

What is claimed is:

1. A coin-operated washing/drying machine, comprising a cabinet and a coin box assembly disposed within the cabinet, wherein a supporting structure is fixedly disposed within the cabinet; at least a bottom surface of the coin box assembly is fixedly connected with the supporting structure by a fastener; and the fastener passes through from the interior of the coin box assembly and is fixedly connected with the supporting structure;

wherein the coin box assembly comprises a coin insertion portion and a coin storage box; an inlet is disposed at a top surface of the coin storage box; and the coin insertion portion has a coin channel leading into the inlet; and a cross beam is connected between the tops of two side plates of the cabinet and the top surface of the coin storage box is fixedly connected with a bottom surface of the cross beam.

2. The coin-operated washing/drying machine according to claim 1, further comprising a drum supporting element for supporting a drum within the cabinet;

wherein the supporting structure is fixed on the drum supporting element.

3. The coin-operated washing/drying machine according to claim 2, wherein the supporting structure is fixed on the drum supporting element in a welding manner.

4. The coin-operated washing/drying machine according to claim 2, wherein the supporting structure is an L-shaped bent plate comprising a first plate and a second plate; one side surface of the first plate is welded to the drum supporting element; and the second plate is fixedly connected with the bottom surface of the coin box assembly by the fastener; and the fastener passes through from the interior of the coin box assembly to be fixedly connected with the second plate.

5. The coin-operated washing/drying machine according to claim 4, wherein one side edge of each of the first plate and the second plate is welded to a side plate of the cabinet close to the coin box assembly.

6. The coin-operated washing/drying machine according to claim 4, wherein the fastener is a screw or a bolt.

7. The coin-operated washing/drying machine according to claim 1, wherein a three-side coaming plate, a top cover plate and a front control panel are disposed at the top of the cabinet and close the cabinet together;

a coin slot is disposed in the coin insertion portion; a first opening is disposed in the control panel; the coin insertion portion passes into the first opening from a back surface of the control panel so as to expose the coin slot to the outside; and the coin storage box comprises a housing and a lockable drawer disposed within the housing in a pushing-pulling manner; a second opening is disposed in the control panel; and the coin storage box passes into the second opening from the back surface of the control panel so as to expose a keyhole of the lockable drawer to the outside.

8. The coin-operated washing/drying machine according to claim 7, wherein the three-side coaming plate comprises a first coaming plate, a second coaming plate and a third coaming plate which are fixed with a back plate and the two side plates of the cabinet by the fasteners, respectively; and the top cover plate is provided with a positioning hole, and is fixedly connected with the second coaming plate and the third coaming plate by positioning screws.

9. The coin-operated washing/drying machine according to claim 8, wherein the positioning hole comprises a first hole close to the control panel, a second hole far away from the control panel and a straight hole for communicating the first hole with the second hole;

each of the positioning screws comprises a nut, a first positioning portion, a second positioning portion and a thread portion successively from top to bottom;

an external dimension of the nut is smaller than an external dimension of the first positioning portion; an external dimension of the first positioning portion is smaller than a dimension of the first hole and greater than a dimension of the second hole; and an external dimension of the second positioning portion is adapted to dimensions of the straight hole and the second hole; and one side edge of the top cover plate is located between the first positioning portion and a top surface of the second coaming plate; the other side edge of the top cover plate is located between the first positioning portion and a top surface of the third coaming plate; the second positioning portion is matched with the second hole; and the thread portion is in threaded connection with the second coaming plate so as to fix the top cover plate.

10. The coin-operated washing/drying machine according to claim 8, wherein the positioning hole comprises a first hole close to the control panel, a second hole far away from the control panel and a straight hole for communicating the first hole with the second hole;

each of the positioning screws comprises a nut, a first positioning portion, a second positioning portion and a thread portion successively from top to bottom;

an external dimension of the nut is smaller than an external dimension of the first positioning portion; an external dimension of the first positioning portion is smaller than a dimension of the first hole and greater than a dimension of the second hole; and an external dimension of the second positioning portion is adapted to dimensions of the straight hole and the second hole; and one side edge of the top cover plate is located between the first positioning portion and the top surface of the second coaming plate; the other side edge of the top cover plate is located between the first positioning portion and the top surface of the third coaming plate; the second positioning portion is matched with the second hole; and the thread portion is in threaded connection with the third coaming plate so as to fix the top cover plate.

11. The coin-operated washing/drying machine according to claim 8, wherein the positioning hole comprises a first hole close to the control panel, a second hole far away from the control panel and a straight hole for communicating the first hole with the second hole;

each of the positioning screws comprises a nut, a first positioning portion, a second positioning portion and a thread portion successively from top to bottom;

an external dimension of the nut is smaller than an external dimension of the first positioning portion; an external dimension of the first positioning portion is smaller than a dimension of the first hole and greater than a dimension of the second hole; and an external dimension of the second positioning portion is adapted to dimensions of the straight hole and the second hole; and one side edge of the top cover plate is located between the first positioning portion and the top surface of the second coaming plate; the other side edge of the top cover plate is located between the first positioning portion and the top surface of the third coaming plate; the second positioning portion is matched with the second hole; and the thread portion is in threaded connection with the second coaming plate and the third coaming plate so as to fix the top cover plate.

* * * * *